US012599243B2

(12) United States Patent
Pan et al.

(10) Patent No.: US 12,599,243 B2
(45) Date of Patent: Apr. 14, 2026

(54) SOFA BED SYSTEM

(71) Applicant: A&C FUTURE, INC., Irvine, CA (US)

(72) Inventors: Qiyin Pan, Irvine, CA (US); Jiuqi Wang, Santa Ana, CA (US); Shoue Chen, Irvine, CA (US); Han Qin, Newport Beach, CA (US); Jiayang Qin, Newport Beach, CA (US)

(73) Assignee: A&C FUTURE, INC., Irvine, CA (US)

( * ) Notice: Subject to any disclaimer, the term of this patent is extended or adjusted under 35 U.S.C. 154(b) by 81 days.

(21) Appl. No.: 18/617,420

(22) Filed: Mar. 26, 2024

(65) Prior Publication Data

US 2025/0302204 A1 Oct. 2, 2025

(51) Int. Cl.
*A47C 17/48* (2006.01)
*A47C 17/213* (2006.01)

(52) U.S. Cl.
CPC ..... *A47C 17/48* (2013.01); *A47C 17/213* (2013.01)

(58) Field of Classification Search
CPC ..... A47C 17/48; A47C 17/38; A47C 17/16; A47C 17/42; A47C 17/52; A47C 17/213; B60N 2/30; B60N 2/34
USPC ..... 5/16, 38, 136
See application file for complete search history.

(56) References Cited

U.S. PATENT DOCUMENTS 3,235,888 A 2/1966 Nystrom
8,464,370 B2 * 6/2013 Beck ..... A47C 17/1753 5/47
10,058,170 B2 8/2018 Gosling et al.
10,085,567 B1 10/2018 Reyes et al.
10,111,529 B2 10/2018 Ray
2006/0150326 A1 7/2006 Miller
2006/0230530 A1 * 10/2006 Avishay ..... A47C 17/38 5/159.1
2014/0101846 A1 * 4/2014 Garland ..... A47C 17/04 5/55.1
2014/0310873 A1 * 10/2014 Gosling ..... A47B 3/00 297/14
2018/0078045 A1 * 3/2018 Neighbours ..... A47C 17/62
2020/0305612 A1 10/2020 Dimitrov
2020/0367658 A1 11/2020 Cohen
2021/0037983 A1 2/2021 Marjadsingh
2022/0185168 A1 * 6/2022 Niemela ..... A47C 17/48
2023/0133923 A1 5/2023 Spurgin

* cited by examiner

*Primary Examiner* — Justin C Mikowski
*Assistant Examiner* — George Samuel Gines
(74) *Attorney, Agent, or Firm* — INNOVATION CAPITAL LAW GROUP, LLP; Vic Lin

(57) ABSTRACT

A sofa bed system has four primary components, including a base unit that functions as a storage shell system and serves to delineate, for example, the separation between the living room and kitchen areas. The sofa seat portion includes the sofa seat frame, sofa seat pad, and seat support. The sofa backrest portion encompasses the sofa backrest, backrest frame support, and armrest. The remaining sofa bed components include the bed pad, bed frame, bed frame support and gas spring mechanism. The sofa bed can be stored within the base unit with the sofa seat pad and the sofa backrest pad being disposed outward, hiding much of the sofa bed framework there behind. The sofa bed can be initially opened into a sofa configuration and further opened into the bed configuration through a unique unfolding process.

20 Claims, 12 Drawing Sheets

SOFA BED SYSTEM

BACKGROUND OF THE INVENTION

1. Field of the Invention

Embodiments of the invention relate generally to foldable furniture. More particularly, embodiments of the invention relate to a sofa bed system that is storable in a wall space, can be partially deployed into a sofa, and can be fully deployed into a bed.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

In smaller structures, such as small homes, apartments or recreational vehicles (RVs), sofa beds can play an important role in converting a larger footprint bed, usable during the night, into a smaller footprint sofa, usable during the daytime. Such structures can save space, however, the sofa seat remains horizontal, taking up floor space, even when neither the sofa nor the bed is needed.

In view of the foregoing, there is a need for sofa bed system that can convert between a sofa and a bed and can further occupy even less space when a sofa and a bed are both not needed.

SUMMARY OF THE INVENTION

Embodiments of the present invention aim to solve the aforementioned problems in conventional sofa beds by providing a sofa bed that can completely fold into a storage unit and can selectively be deployed as a sofa or a bed.

Embodiments of the present invention provide a sofa bed comprising a sofa seat frame; a sofa back frame having a distal side pivotably attached to a proximate side of the sofa seat frame; and a bed frame having a distal side pivotably attached to a proximate side of the sofa back frame; wherein the sofa bed system is movable between a fully stored position, with the sofa bed system positioned within a storage unit, a sofa position, where the bed frame remains in the storage unit, and a bed position, where each of the sofa seat frame, the bed frame and the sofa back frame are horizontally aligned out of the storage compartment; and the proximate sides of the sofa seat frame and the sofa back frame and the distal sides of the sofa back frame and the bed frame are defined when the sofa bed system is in the bed position, relative to an interior space of the storage unit.

Embodiments of the present invention provide a sofa bed system comprising a storage unit having a front surface and a recessed space formed therein accessible from the front surface; and a sofa bed, the sofa bed comprising a sofa seat frame; a sofa back frame having a distal side pivotably attached to a proximate side of the sofa seat frame; and a bed frame having a distal side pivotably attached to a proximate side of the sofa back frame; wherein the sofa bed system is movable between a fully stored position, with the sofa bed system positioned within the recessed space of the storage unit, a sofa position, where the bed frame remains in the recessed space of the storage unit, and a bed position, where each of the sofa seat frame, the bed frame and the sofa back frame are horizontally aligned out of the storage compartment; and the proximate sides of the sofa seat frame and the sofa back frame and the distal sides of the sofa back frame and the bed frame are defined when the sofa bed system is in the bed position, relative to the front surface of the storage unit.

Embodiments of the present invention provide a sofa bed comprising a sofa seat frame; a sofa back frame having a distal side pivotably attached to a proximate side of the sofa seat frame; a bed frame having a distal side pivotably attached to a proximate side of the sofa back frame; a sofa seat pad disposed on the sofa seat frame; a sofa back pad disposed on the sofa back frame; a bed pad disposed on the bed frame; and sofa seat legs pivotably attached at opposite sides of the sofa seat frame, the sofa seat legs movable between a stored position, adjacent to the sofa seat frame, and a use position, extending downward from the sofa seat frame, wherein the sofa bed system is movable between a fully stored position, with the sofa bed system positioned within a storage unit, a sofa position, where the bed frame remains in the storage unit, and a bed position, where each of the sofa seat frame, the bed frame and the sofa back frame are horizontally aligned out of the storage compartment; the proximate sides of the sofa seat frame and the sofa back frame and the distal sides of the sofa back frame and the bed frame are defined when the sofa bed system is in the bed position, relative to an interior space of the storage unit; the sofa seat pad, the sofa back pad and the bed pad are horizontally aligned and have upper surfaces facing upward when the sofa bed is in the bed position; and the upper surfaces of the sofa seat pad and the sofa back pad faces outward when the sofa bed is in the fully stored position.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 2:
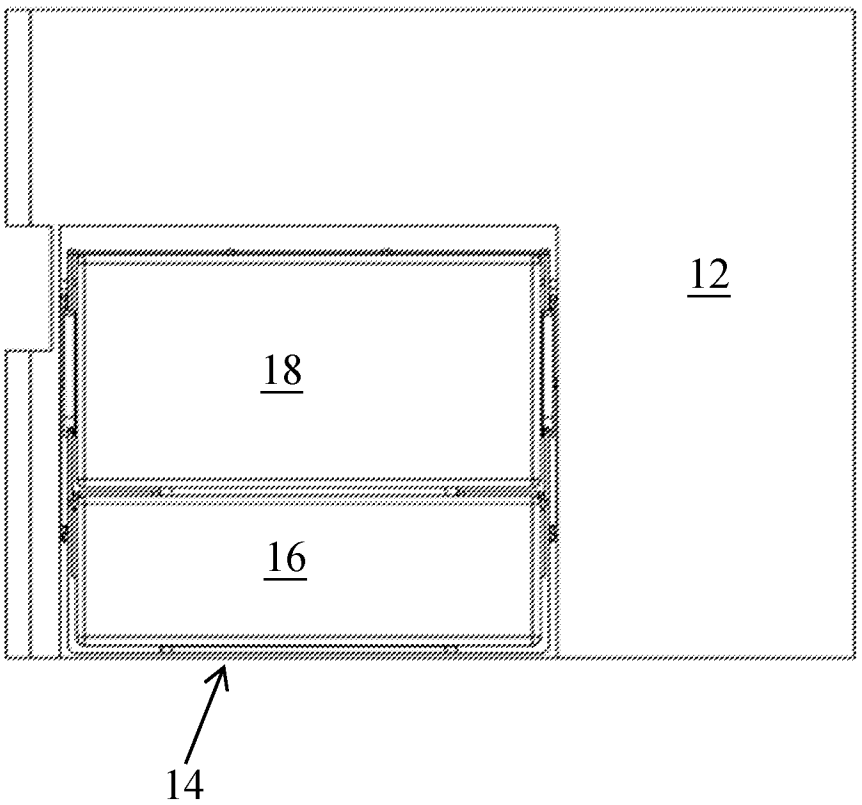
FIG. 2 illustrates a front view of the sofa bed system of FIG. 1.

The illustrations in the figures may not necessarily be drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

As is well known to those skilled in the art, many careful considerations and compromises typically must be made when designing for the optimal configuration of a commercial implementation of any system, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide a sofa bed system that includes four primary components, including a base unit that functions as a storage shell system and serves to delineate, for example, the separation between the living room and kitchen areas. The sofa seat portion includes the sofa seat frame, sofa seat pad, and seat support. The sofa backrest portion encompasses the sofa backrest, backrest frame support, and armrest. The remaining sofa bed components include the bed pad, bed frame, bed frame support and gas spring mechanism. The sofa bed can be stored within the base unit with the sofa seat pad and the sofa backrest pad being disposed outward, hiding much of the sofa bed framework there behind. The sofa bed can be initially opened into a sofa configuration and further opened into the bed configuration through a unique unfolding process.

As described in greater detail below, the sofa bed system seamlessly transitions to a fully flat position, perpendicular to the ground. This manual process is augmented by additional gas springs to provide enhanced assistance. To ensure safety during transit, latches are incorporated to secure both the bed and seat components. To convert the folded condition to a sofa, the user simply releases the seat latch, then pulls the handle on the seat frame outward and extend the seat support. Once the seat support is firmly grounded, the seat can be pulled outwards to achieve a flat position, with armrests available on either side.

Similarly, transforming the sofa into a bed is a straightforward process. The user releases the bed latch to unlock the bed hinge located behind the backrest. Then, pulling the handle on the seat frame outward allows the bed to extend outward, accompanied by the simultaneous extension of the bed frame support and backrest frame support.

Reverting to sofa configuration entails performing the aforementioned steps in reverse, ensuring all latches are securely engaged. This straightforward operation ensures convenience and ease of use for the user.

Figure 1:
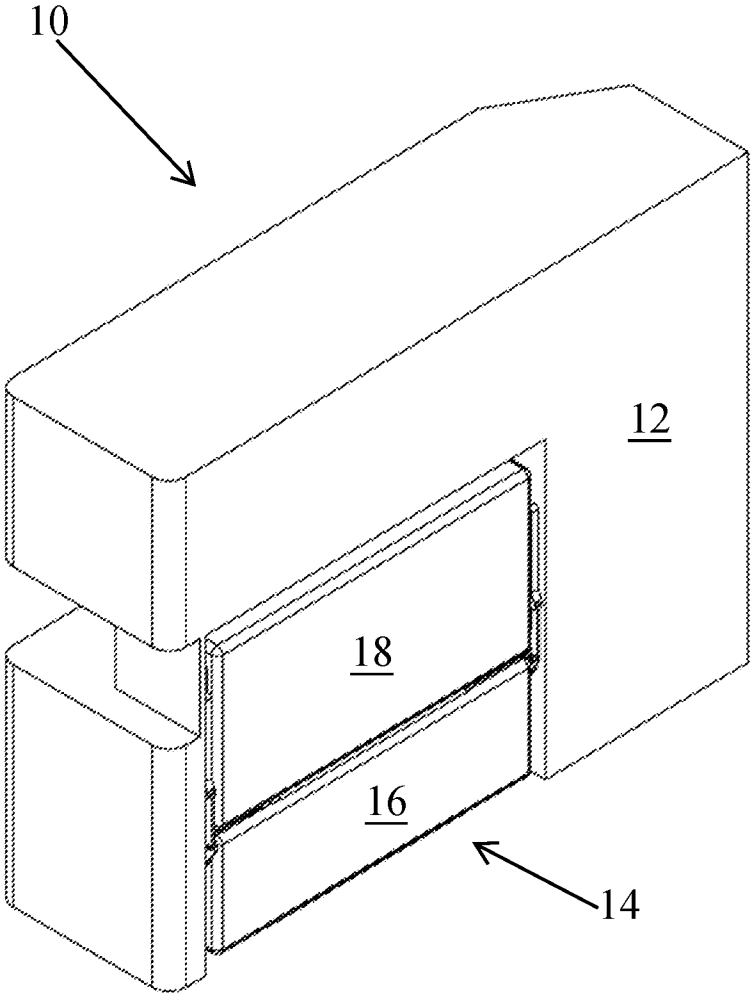
FIG. 1 illustrates a perspective view of a sofa bed system in a folded configuration, according to an exemplary embodiment of the present invention.

Referring to FIGS. 1 and 2, a sofa bed system 10 can include a storage unit 12 and a sofa bed 14 stored therein. The storage unit 12 can be configured in various locations within a home or recreational vehicle, such as a room divider or along an exterior wall, for example. As shown in the figures, in the storage position, an entirety of the sofa bed 14 can be disposed within the storage unit 12. In some embodiments, the sofa bed 14 does not extend beyond a plane defined by a front of the storage unit 12.

Figure 4:
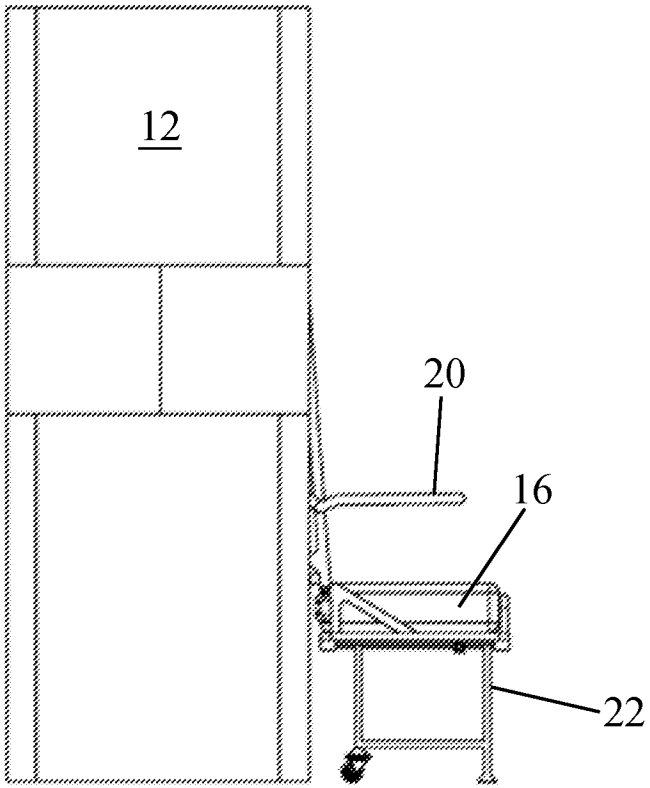
FIG. 4 illustrates a side view of the sofa bed system of FIG. 3, in the sofa configuration.
Figure 3:
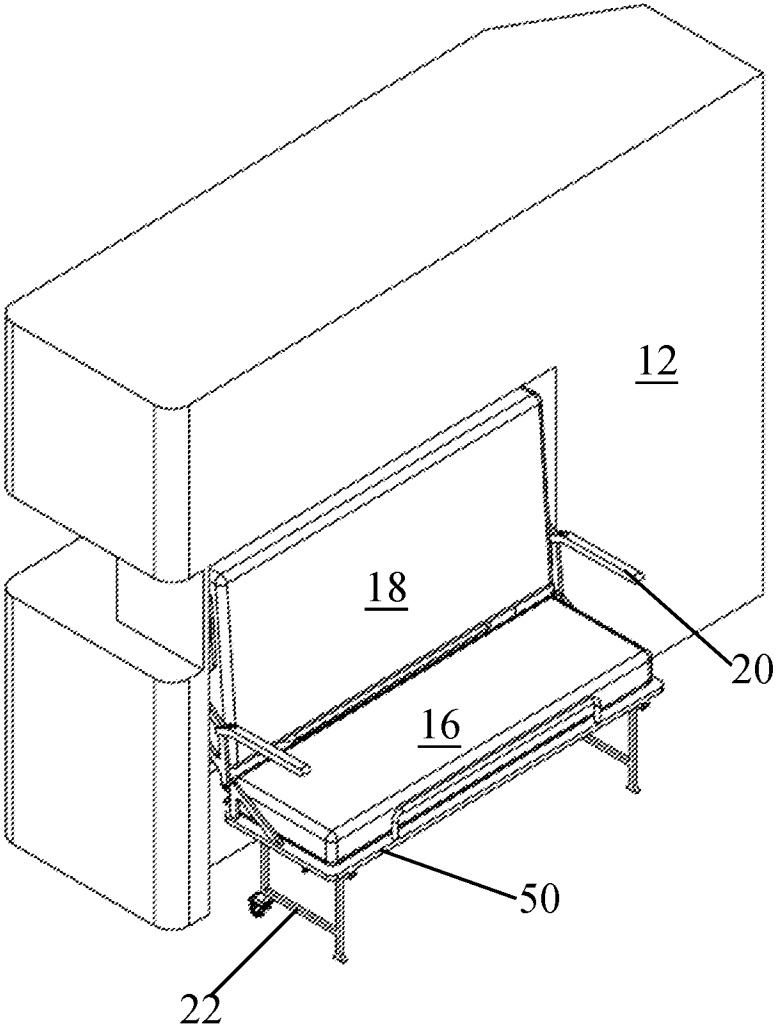
FIG. 3 illustrates a perspective view of the sofa bed system of FIG. 1 in a sofa configuration, according to an exemplary embodiment of the present invention.

Referring to FIGS. 3 and 4, the sofa bed system 10 can be deployed into a sofa configuration, where a sofa seat pad 16 is supported by a sofa seat frame 50 in a substantially horizontal configuration. The sofa seat frame 50 can be supported with folding legs 22. A sofa back pad 18 can provide a back seat cushion for the sofa. Armrests 20 can be folded out to provide armrest for users of the sofa.

Figure 6:
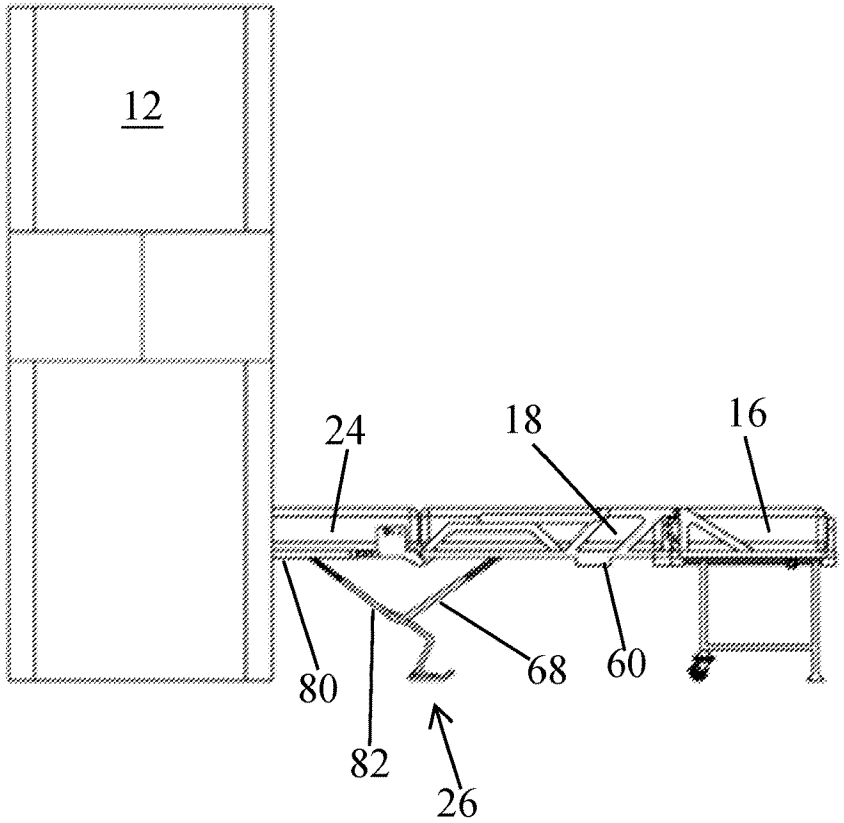
FIG. 6 illustrates a side view of the sofa bed system of FIG. 5, in the bed configuration.
Figure 5:
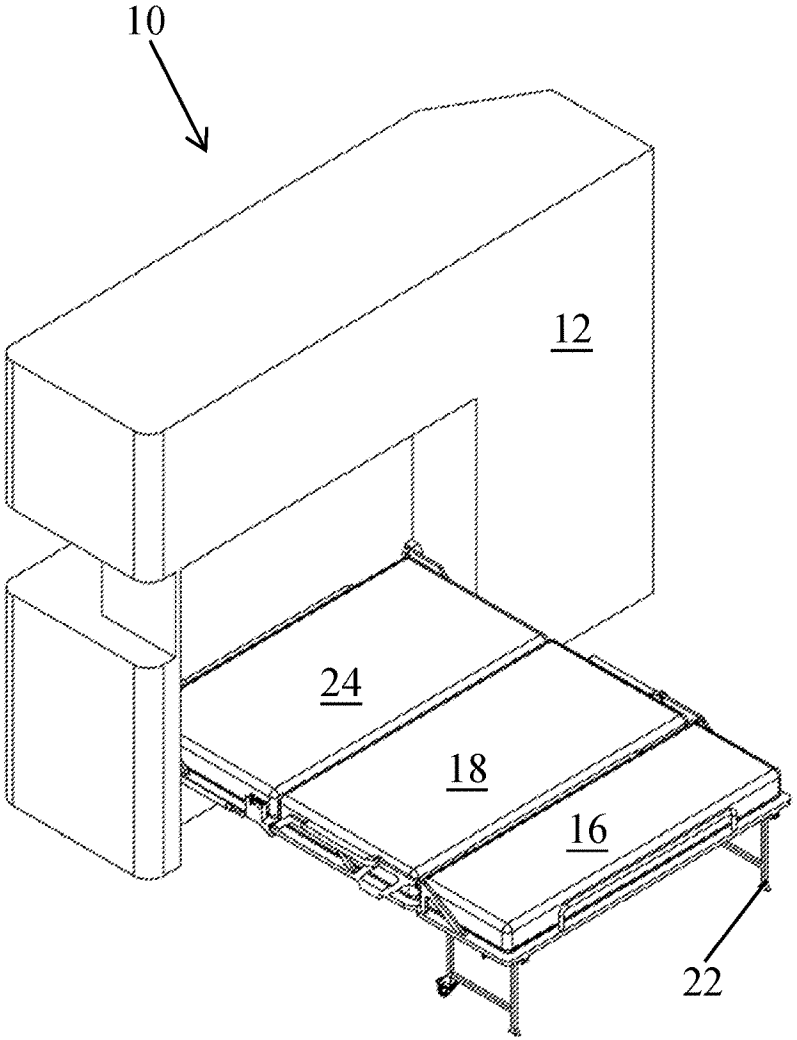
FIG. 5 illustrates a perspective view of the sofa bed system of FIG. 1 in a bed configuration, according to an exemplary embodiment of the present invention.

Referring to FIGS. 5 and 6, the sofa bed system 10 can be deployed into a bed configuration, where the sofa seat pad 16, the sofa back pad 18 and the bed pad 24 make up the upper surface of the bed. The sofa seat frame 50 can be supported with folding legs 22, similar to when the sofa bed is in the sofa configuration. A sofa back frame 60 can support the sofa back pad 18 and can, itself, be supported by a seat back pivoting leg member 68. A bed configuration leg assembly 26 can be formed by the pivoting leg member 68 being pivotably interconnected with a bed pivoting leg member 82 to support both the seat back frame 60 and a bed frame 80 on a surface, such as a room floor (not shown).

Figure 7:
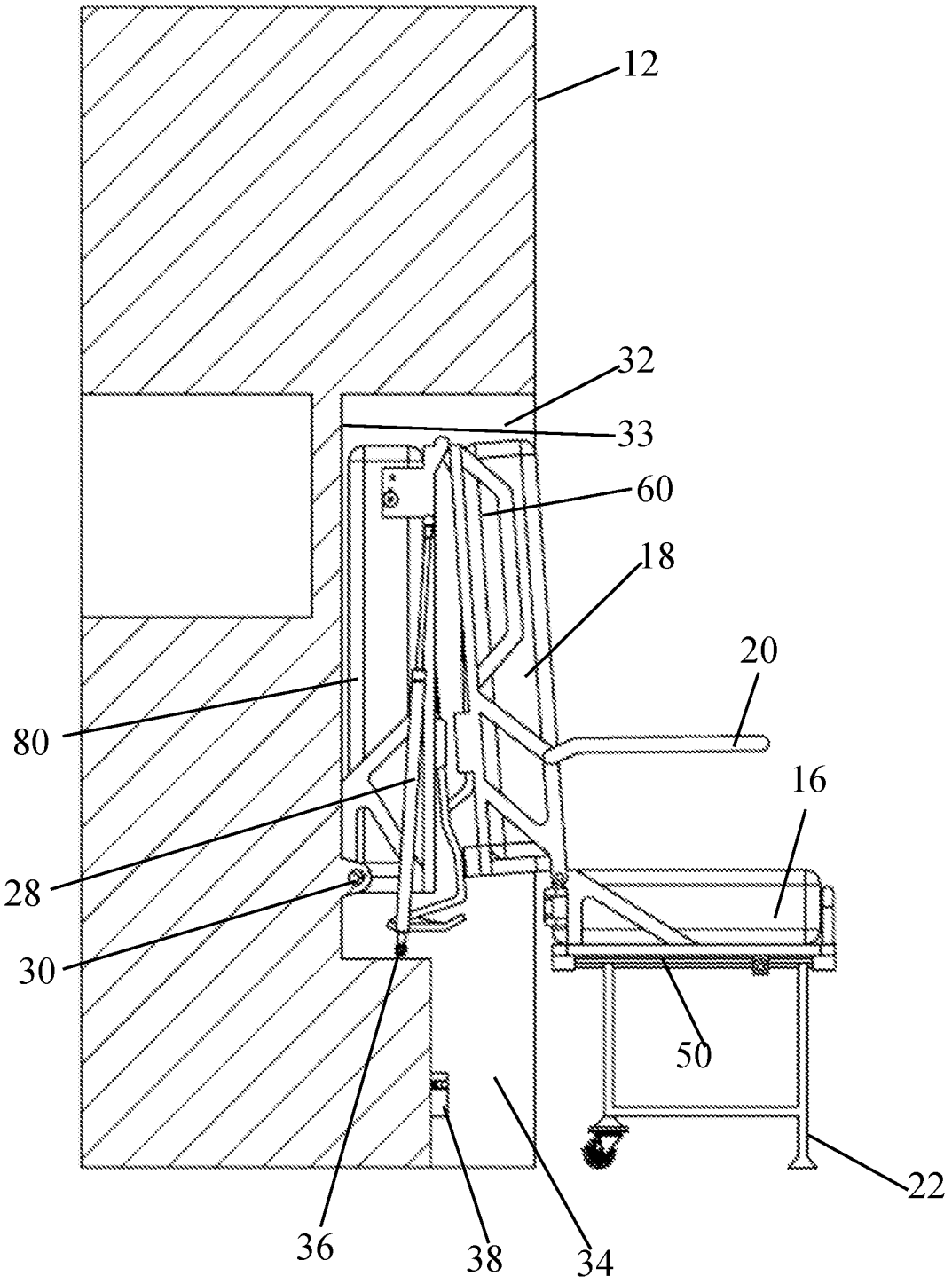
FIG. 7 illustrates side view of the sofa bed system of FIG. 1, in the sofa configuration, with the storage unit cut away to illustrate the structure of the sofa bed.

Referring to FIG. 7, the sofa bed is shown in the sofa configuration. The storage unit 12 can include an upper space 32 for storing the bed frame 80, the bed pad 24, the sofa back frame 60 and the sofa back pad 18 therein. The storage unit 12 can further include a lower space 34, continuous with the upper space but having a smaller depth, that can contain the sofa seat frame 50 and the sofa seat pad 16 in the storage configuration (see FIGS. 1 and 2). A latch system 38 may be disposed in the lower space 34 to retain the sofa seat frame 50 in the storage configuration until such a time the user releases the latch system 38. Various mechanisms may be used for the latch system 38 and latch release, such as a spring-loaded latch bar that is released by a pull-type release, a pressure fitted connection, a turn latch, or the like.

The bed frame 80 can attach at a bed frame pivot connection 30 to a fixed location inside the upper space 32, adjacent a back wall 33 thereof. Gas struts 28 can be further positioned inside the upper space 32, where the gas struts 28 are pivotably attached to a strut pivot location 36 within a lower part of the upper space 32, at a first end thereof, and are pivotably attached to the bed frame 80 at another end thereof. Typically two gas struts 28 are used, but additional gas struts 28 can be used depending on the particular application. The gas struts 28 can help dampen movement of the sofa bed system while it is being converted between the storage, the sofa and the bed configurations.

Figure 8:
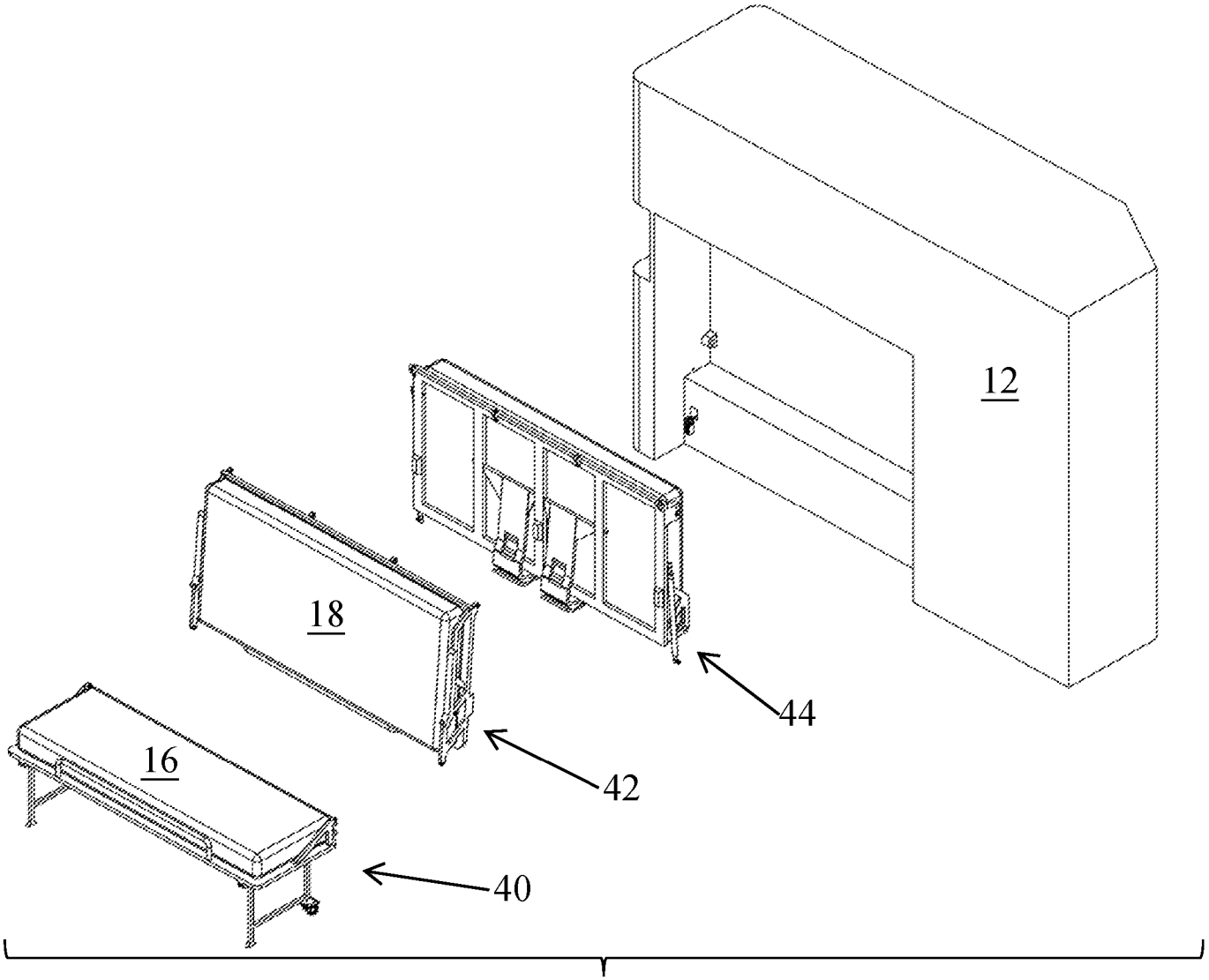
FIG. 8 illustrates a partially exploded perspective view of the sofa bed system of FIG. 1.
Figure 9:
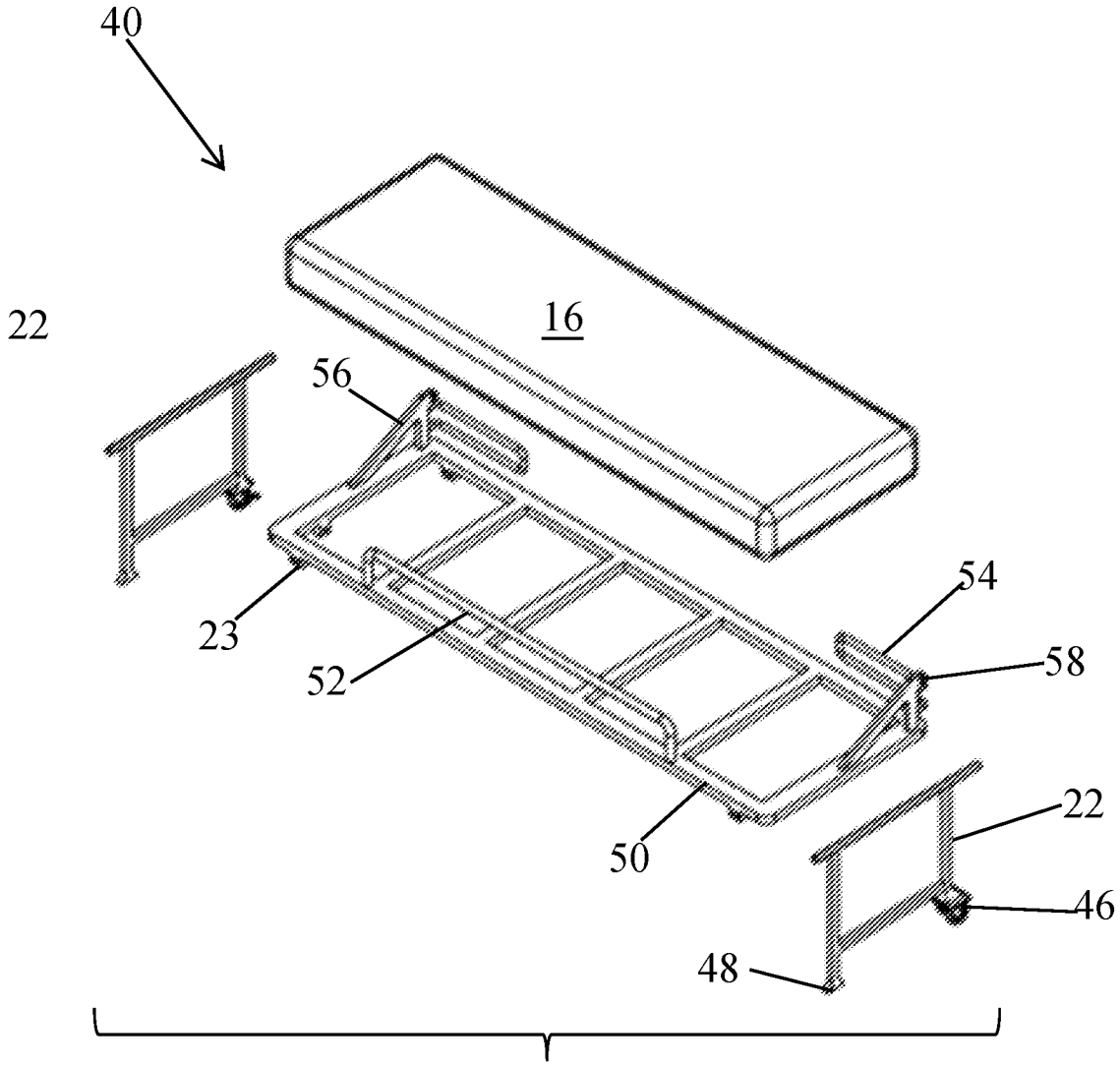
FIG. 9 illustrates an exploded view of the sofa seat portion of the sofa bed system of FIG. 8.
Figure 10:
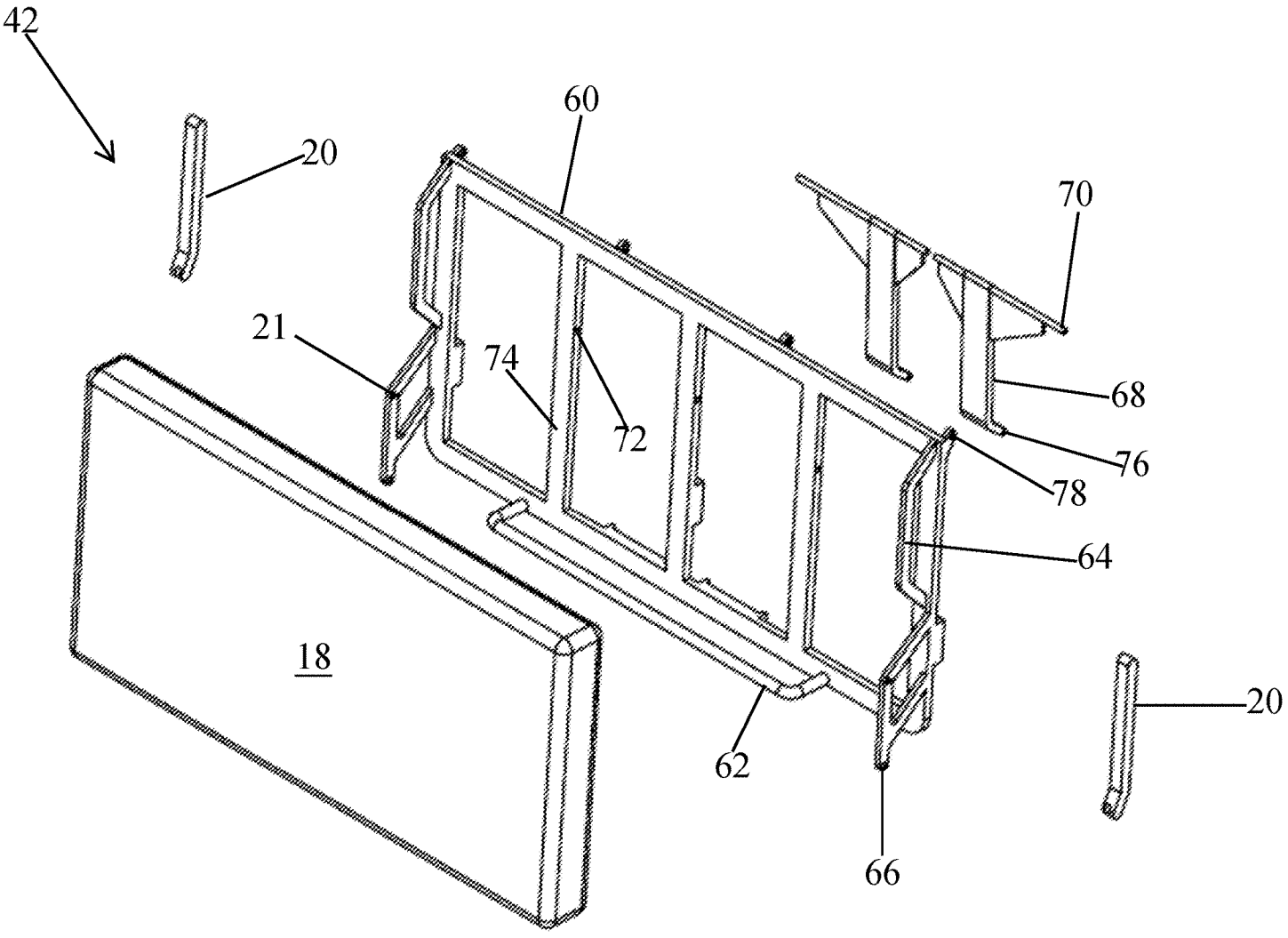
FIG. 10 illustrates an exploded view of the sofa back portion of the sofa bed system of FIG. 8.
Figure 11:
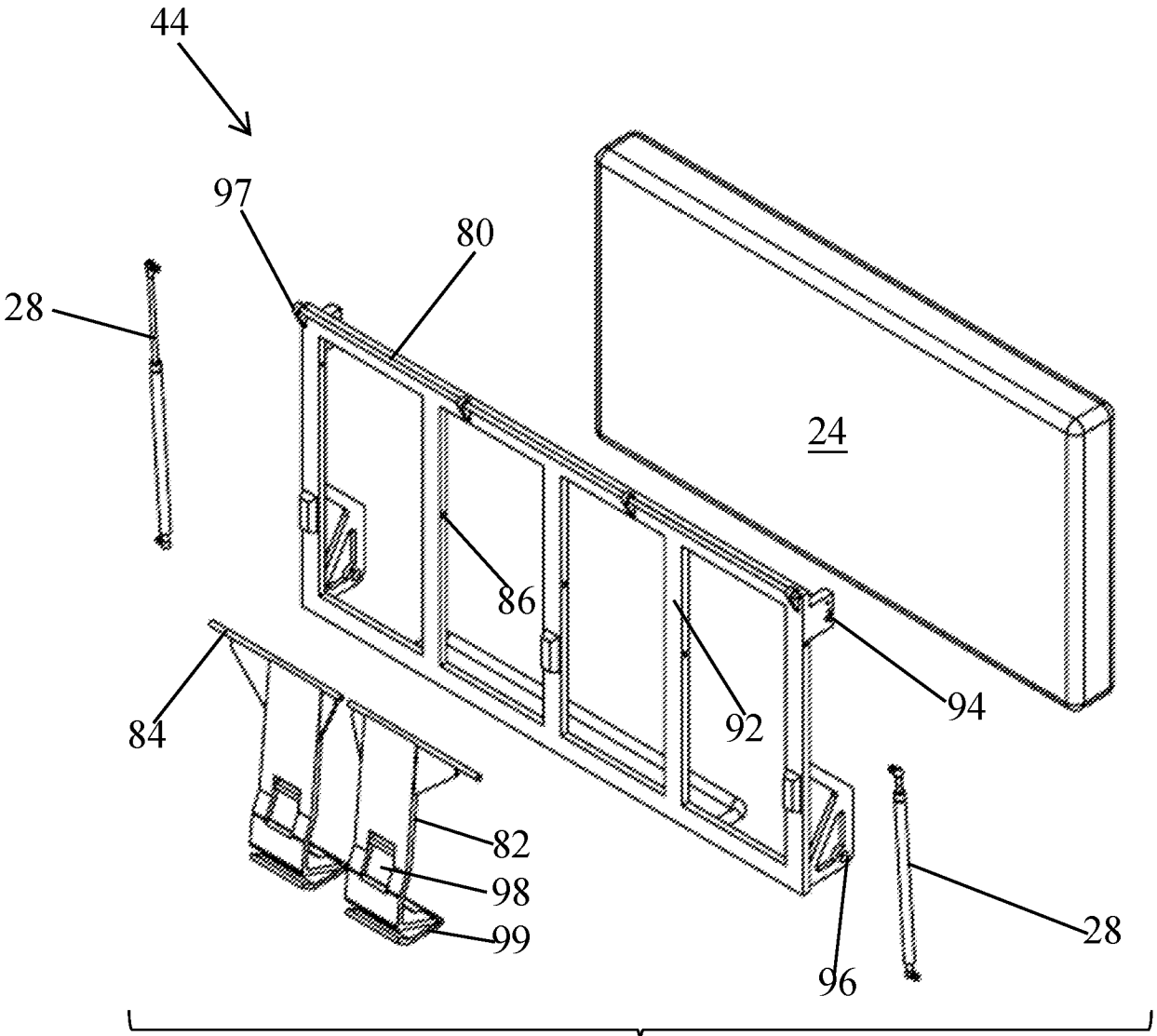
FIG. 11 illustrates an exploded view of the inner bed portion of the sofa bed system of FIG. 8.

Referring to FIG. 8, the sofa bed system 10 can be split into a sofa seat portion 40, a sofa back portion 42 and a bed portion 44. Referring to FIGS. 9, 10 and 11, details of each of the sofa seat portion 40, the sofa back portion 42 and the bed portion 44 are described. The sofa seat portion 40 can include the sofa seat frame 50. The sofa seat frame 50 can include a front pad retainer 52, a rea pad retainer 54 and side pad retainers 56 configured to hold the sofa seat pad 16 on the sofa seat frame 50. The legs 22 can pivot within pivot connectors 23 provided on a bottom side of the sofa seat frame 50. Each leg 22 can include two ground contacting portions—a wheel 46 and a stationary contact 48—that can operate together to secure the sofa seat portion 40 in the sofa configuration or the bed configuration. When in the storage configuration, the sofa seat pad 16 faces outward to provide a clean outward appearance.

The sofa seat frame 50 can include a seat frame pivot connection 58 on each side thereof that can pivotably attach to a seat back pivot connection 66 on the seat back frame 60 of the seat back portion 42 shown in FIG. 10. The seat back frame 60 can include a front arm 62 and side arms 64 that can maintain the seat back pad 18 onto the seat back frame 60. A seat back leg 68 can include pivot arms 76 that can pivotably connect to seat back leg pivot connectors 70 formed on cross arms 74 of the seat back frame 60. The seat back leg 68 can include a bent connection end 76 for attachment to the bed leg 82, described below.

Arm rests 20 can pivotably attach to the seat back frame 60 at armrest pivot locations 21. The arm rests 20 can be movable between a storage position, positioned within the storage unit 10 when in the storage configuration (see FIGS. 1 and 2) and a use position, providing arm rests when in the sofa configuration.

The seat back frame 60 can further include a seat back frame-bed frame pivot location 78 for pivotably connecting the bed frame 80, as described below.

The bed portion 44, shown in FIG. 11, can include the bed frame 80 having bed frame pivot locations 96 where the bed frame can pivot with the interior of the storage unit 10. The bed frame 80 can further include a bed frame-seat back frame pivot connection 97, where the seat back frame-bed frame pivot location 78 pivotably connects to permit movement between the sofa configuration and the bed configuration. The bed frame 80 can further include a gas strut pivot location 94 for attachment of one end of the gas strut 28.

Figure 13:
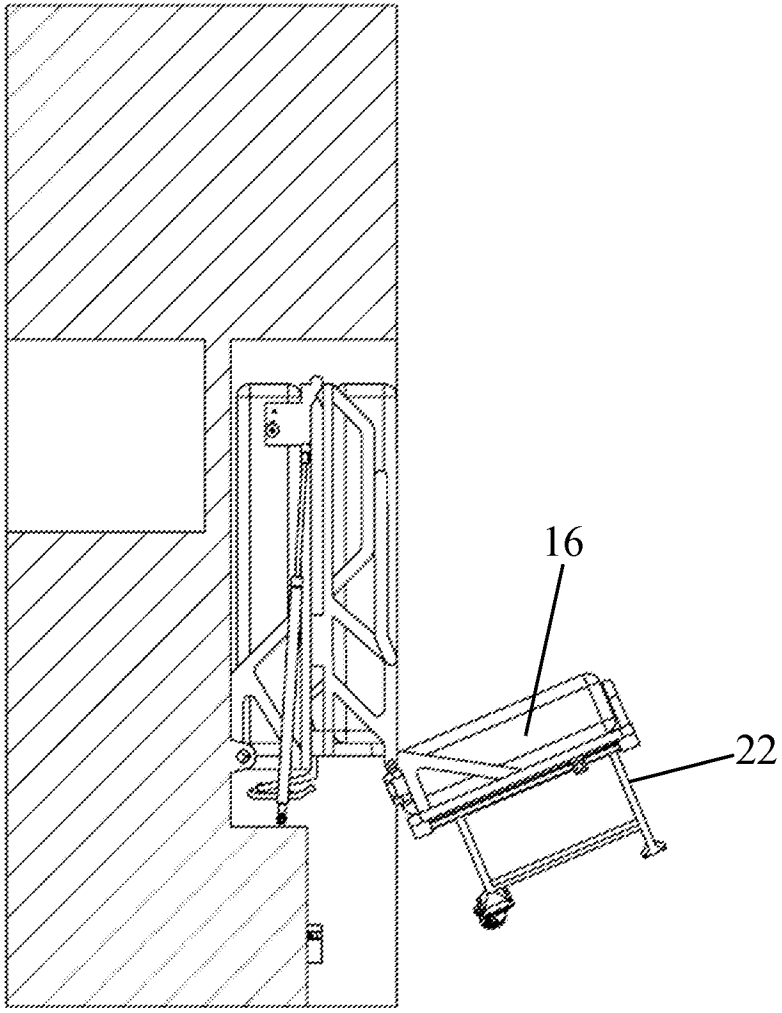
FIG. 13 illustrates a side view of the sofa bed system of FIG. 1 in a partially unfolded sofa configuration.
Figure 12:
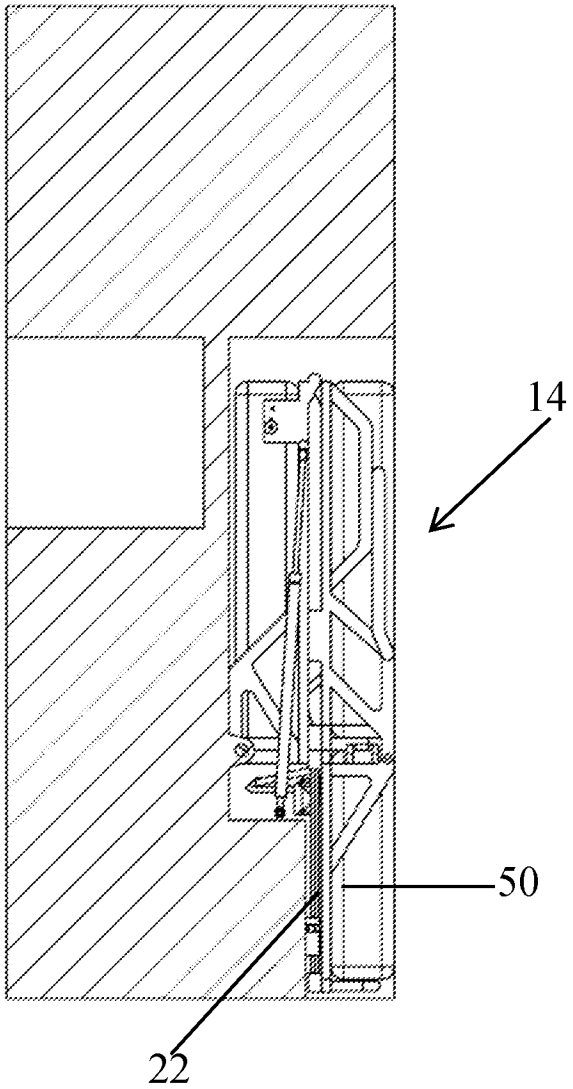
FIG. 12 illustrates a side view of the sofa bed system of FIG. 1 in a fully folded (storage) configuration.
Figure 15:
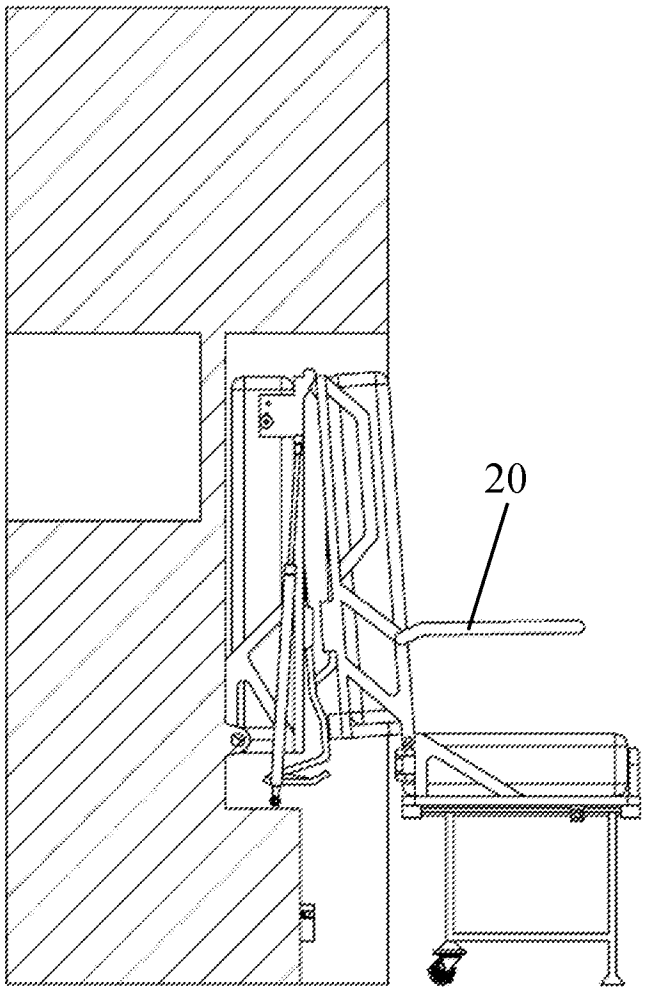
FIG. 15 illustrates a side view of the sofa bed system of FIG. 1 in a sofa configuration.
Figure 14:
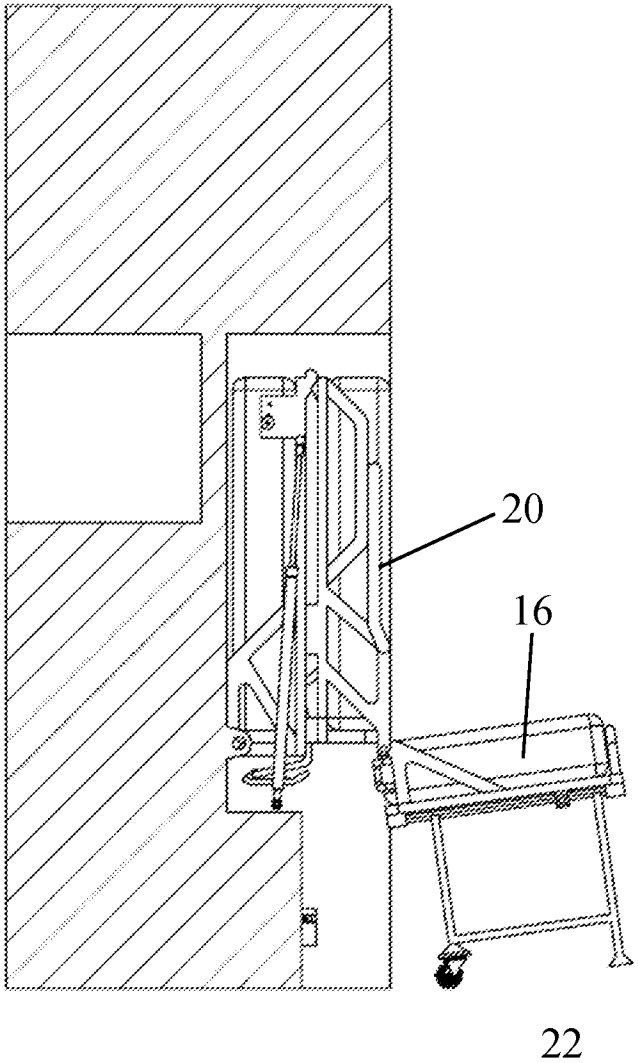
FIG. 14 illustrates a side view of the sofa bed system of FIG. 1 in a partially unfolded sofa configuration.

Bed frame legs 82 can be pivotably attached by pivotably connecting bed frame leg arms 84 into pivot locations 86 located in cross arms 92 of the bed frame 80. The bed frame legs 82 can include an opening 98 for receiving the bent connection ends 76 of the seat back legs 68 therein. A bottom member 99 may provide contact with a floor surface when the sofa bed is deployed in a bed configuration. The bed pad 24 may be held in place with a rear support bar Referring now to FIGS. 12 through 17, the conversion of the sofa bed 14 from the storage configuration (FIG. 12) to the sofa configuration (FIG. 15) to the bed configuration (FIG. 17) is shown. In FIGS. 13 and 14, the sofa bed frame 50 is pivoted outward and the legs 22 are folded downward. Once the legs 22 are fully unfolded, the sofa configuration can be achieved by unfolding the arms 20. A leg lock (not shown) may be configured to keep the legs 22 from folding inward while in the sofa or bed configurations.

Figure 16:
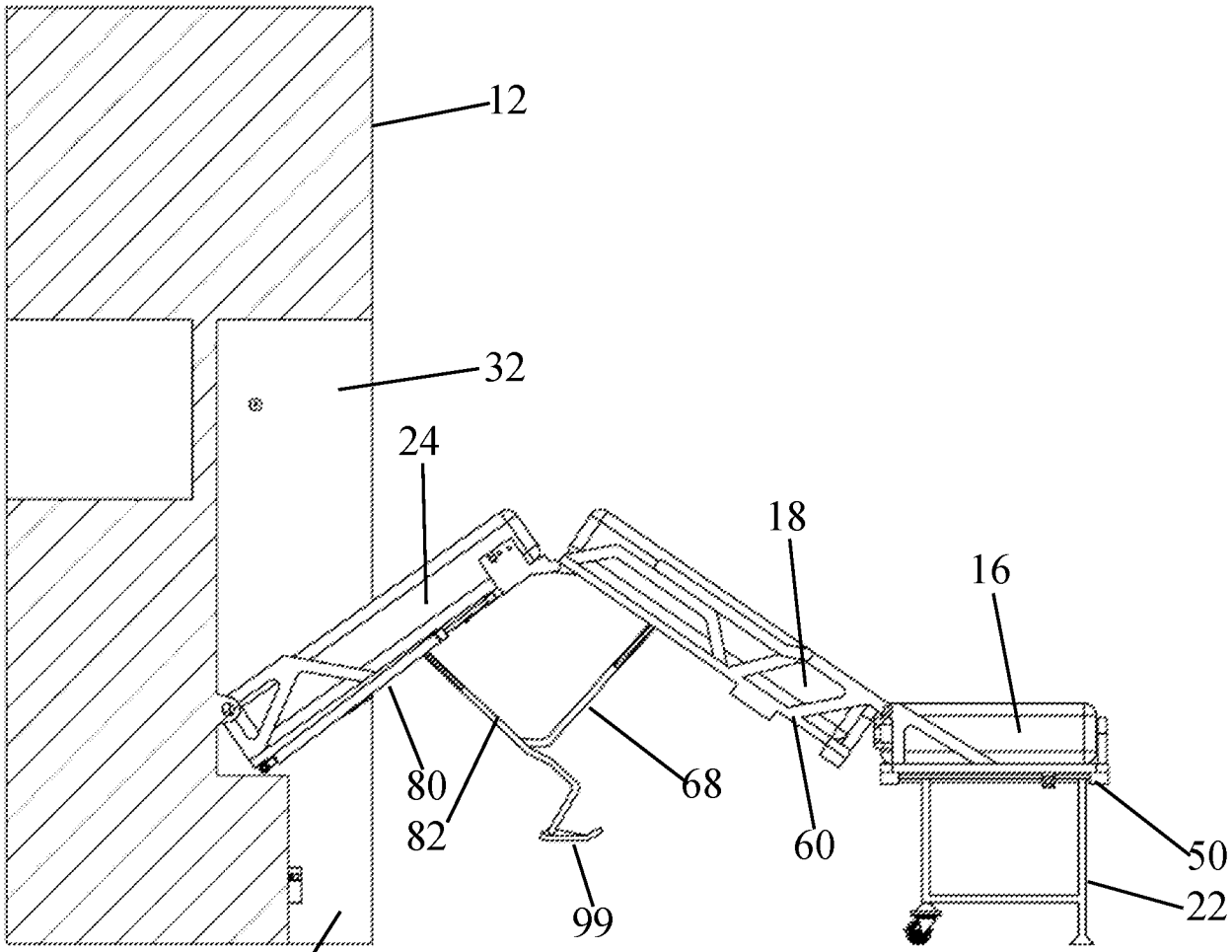
FIG. 16 illustrates a side view of the sofa bed system of FIG. 1 in a partially unfolded bed configuration.
Figure 17:
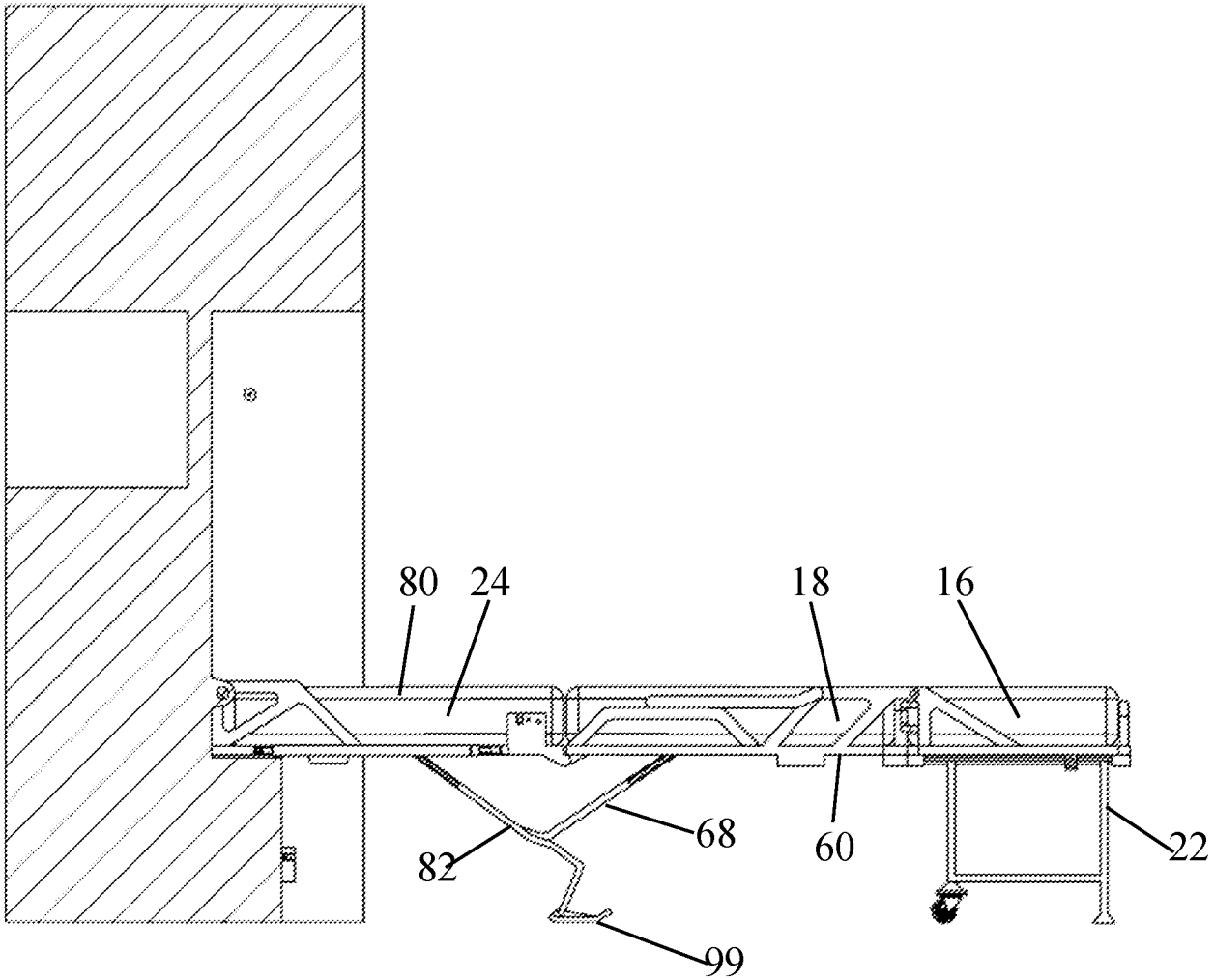
FIG. 17 illustrates a side view of the sofa bed system of FIG. 1 in a in a bed configuration.

As shown in FIG. 16, the sofa frame 50 can be pulled away from the storage unit 12 to cause the sofa back pad 18 to move toward a horizontal position, where the sofa back frame 60 (at a proximate end thereof, proximate relative to the storage unit 12) pivots with a distal end of the bed frame 80. The sofa back leg 68 pivots in the bed frame leg 82 to form the bed configuration leg assembly 26. Where the leg base 99 can provide a contact with the floor in the bed configuration as shown in FIG. 17.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A sofa bed, comprising: a sofa seat frame; a sofa back frame having a distal side pivotably attached to a proximate side of the sofa seat frame; and a bed frame having a distal side pivotably attached to a proximate side of the sofa back frame; wherein: the sofa bed is movable between: a fully stored position, with the sofa bed positioned within a storage unit comprising a tiered recessed space having an upper space of a first depth and a lower space of a second depth smaller than the first depth, a sofa position, where the bed frame remains sequestered in the upper space of storage unit, while the sofa seat frame is deployed from the lower space, and a bed position, where each of the sofa seat frame, the bed frame and the sofa back frame are horizontally aligned out of the storage unit; and the proximate sides of the sofa seat frame and the sofa back frame and the distal sides of the sofa back frame and the bed frame are defined when the sofa bed is in the bed position, relative to an interior space of the storage unit.

2. The sofa bed of claim 1, further comprising:

a sofa seat pad disposed on the sofa seat frame;

a sofa back pad disposed on the sofa back frame; and a bed pad disposed on the bed frame, wherein the sofa seat pad, the sofa back pad and the bed pad are horizontally aligned and have upper surfaces facing upward when the sofa bed is in the bed position.

3. The sofa bed of claim 2, wherein the upper surfaces of the sofa seat pad and the sofa back pad faces outward when the sofa bed is in the fully stored position.

4. The sofa bed of claim 2, wherein the upper surface of the bed pad faces a back wall of the interior space of the storage unit when the sofa bed is in the fully stored position.

5. The sofa bed of claim 1, further comprising sofa seat legs pivotably attached at opposite sides of the sofa seat frame, the sofa seat legs movable between a stored position, adjacent to the sofa seat frame, and a use position, extending downward from the sofa seat frame.

6. The sofa bed of claim 5, wherein the sofa seat legs each include a first floor contact and a second floor contact, the first floor contact being a wheel and the second floor contact being a stationary contact leg end.

7. The sofa bed of claim 1, further comprising arms pivotably attached to the sofa back frame, the arms movable to a sofa use position to provide arms on each end of the sofa seat frame.

8. The sofa bed of claim 1, further comprising at least one strut member connected between the interior space of the storage unit and a distal end of the bed frame, the at least one strut member providing dampening of motion as the sofa bed is moved between the sofa configuration and the bed configuration.

9. The sofa bed of claim 1, further comprising a latch mechanism operable to retain the sofa seat frame in the fully stored position.

10. A sofa bed system comprising: a storage unit having a front surface and a tiered recessed space formed therein accessible from the front surface, wherein the tiered recessed space comprises an upper space of a first depth and a lower space of a second depth smaller than the first depth; and a sofa bed, the sofa bed comprising: a sofa seat frame; a sofa back frame having a distal side pivotably attached to a proximate side of the sofa seat frame; and a bed frame having a distal side pivotably attached to a proximate side of the sofa back frame; wherein: the sofa bed system is movable between a fully stored position, with the sofa bed system positioned within the recessed space of the storage unit, a sofa position, where the bed frame remains in the recessed space of the storage unit, and a bed position, where each of the sofa seat frame, the bed frame and the sofa back frame are horizontally aligned out of the storage unit; and the proximate sides of the sofa seat frame and the sofa back frame and the distal sides of the sofa back frame and the bed frame are defined when the sofa bed system is in the bed position, relative to the front surface of the storage unit.

11. The sofa bed system of claim 10, wherein the sofa bed is completely contained within the recessed space in the fully stored position.

12. The sofa bed system of claim 10, further comprising:

a sofa seat pad disposed on the sofa seat frame;

a sofa back pad disposed on the sofa back frame; and a bed pad disposed on the bed frame, wherein:

the sofa seat pad, the sofa back pad and the bed pad are horizontally aligned and have upper surfaces facing upward when the sofa bed is in the bed position;

the upper surfaces of the sofa seat pad and the sofa back pad faces outward when the sofa bed is in the fully stored position; and the upper surface of the bed pad faces a back wall of the interior space of the storage unit when the sofa bed is in the fully stored position.

13. The sofa bed system of claim 10, further comprising sofa seat legs pivotably attached at opposite sides of the sofa seat frame, the sofa seat legs movable between a stored position, adjacent to the sofa seat frame, and a use position, extending downward from the sofa seat frame.

14. The sofa bed system of claim 13, wherein the sofa seat legs each include a first floor contact and a second floor contact, the first floor contact being a wheel and the second floor contact being a stationary contact leg end.

15. The sofa bed system of claim 10, further comprising arms pivotably attached to the sofa back frame, the arms movable to a sofa use position to provide arms on each end of the sofa seat frame.

16. The sofa bed system of claim 10, further comprising at least one strut member connected between the interior space of the storage unit and a distal end of the bed frame, the at least one strut member providing dampening of motion as the sofa bed is moved between the sofa configuration and the bed configuration.

17. The sofa bed system of claim 10, further comprising a latch mechanism operable to retain the sofa seat frame in the fully stored position.

18. A sofa bed, comprising: a storage unit having a front surface and a tiered recessed space formed therein accessible from the front surface, wherein the tiered recessed space comprises an upper space of a first depth and a lower space of a second depth smaller than the first depth; and a sofa seat frame; a sofa back frame having a distal side pivotably attached to a proximate side of the sofa seat frame; a bed frame having a distal side pivotably attached to a proximate side of the sofa back frame; a sofa seat pad disposed on the sofa seat frame; a sofa back pad disposed on the sofa back frame; a bed pad disposed on the bed frame; and sofa seat legs pivotably attached at opposite sides of the sofa seat frame, the sofa seat legs movable between a stored position, adjacent to the sofa seat frame, and a use position, extending downward from the sofa seat frame, wherein: the sofa bed is movable between a fully stored position, with the sofa bed positioned within a storage unit, a sofa position, where the bed frame remains in the storage unit, and a bed position, where each of the sofa seat frame, the bed frame and the sofa back frame are horizontally aligned out of the storage unit; the proximate sides of the sofa seat frame and the sofa back frame and the distal sides of the sofa back frame and the bed frame are defined when the sofa bed is in the bed position, relative to an interior space of the storage unit; the sofa seat pad, the sofa back pad and the bed pad are horizontally aligned and have upper surfaces facing upward when the sofa bed is in the bed position; and the upper surfaces of the sofa seat pad and the sofa back pad faces outward when the sofa bed is in the fully stored position.

19. The sofa bed of claim 18, further comprising arms pivotably attached to the sofa back frame, the arms movable to a sofa use position to provide arms on each end of the sofa seat frame.

20. The sofa bed of claim 18, further comprising at least one strut member connected between the interior space of the storage unit and a distal end of the bed frame, the at least one strut member providing dampening of motion as the sofa bed is moved between the sofa configuration and the bed configuration.

* * * * *